United States Patent [19]

Ogasawara

[11] 4,399,826

[45] Aug. 23, 1983

[54] VANITY CASE

[75] Inventor: Hirotake Ogasawara, Funabashi, Japan

[73] Assignee: Yoshida Industry Co., Ltd., Tokyo, Japan

[21] Appl. No.: 386,419

[22] Filed: Jun. 8, 1982

[30] Foreign Application Priority Data

Dec. 9, 1981 [JP] Japan ..... 56-182138[U]

[51] Int. Cl.[3] ..... A45D 33/00

[52] U.S. Cl. ..... 132/83 R

[58] Field of Search ..... 132/83 R, 82 F

[56] References Cited

U.S. PATENT DOCUMENTS 1,416,223 5/1922 Marcher ..... 132/83 R 1,592,136 7/1926 Davis ..... 132/83 R 4,366,829 1/1983 Yuhara ..... 132/83 R

*Primary Examiner*—Gregory E. McNeill

*Attorney, Agent, or Firm*—Wenderoth, Lind & Ponack

[57] ABSTRACT

A vanity case is provided in which an angularly shaped unlatch member including a horizontally extended portion and a vertically extended portion is pivotably connected at the angular corner thereof to either one of a receptacle and a cover member in a rectangular recess. The unlatch member is so arranged that when one of the extended portions is pressed to have the unlatch member pivot about the corner, the other extended portion acts on a flat surface of the other of the cover and the receptacle so as to release a snap engagement between the cover and the receptacle members.

5 Claims, 13 Drawing Figures

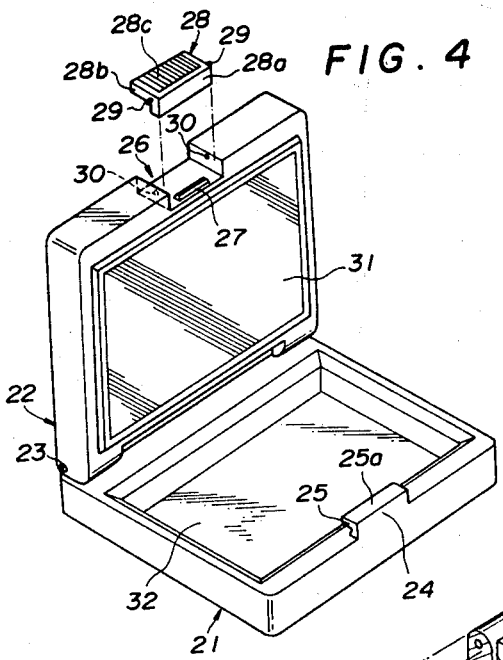
FIG. 4
FIG. 5
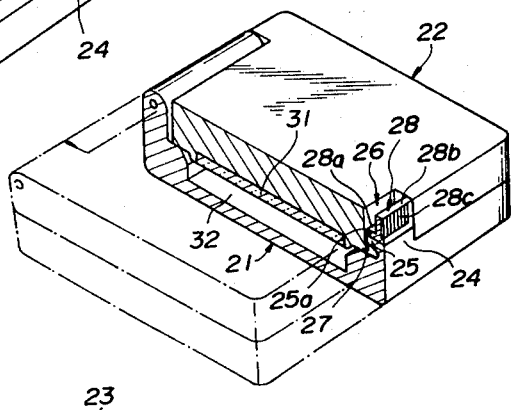
FIG. 6
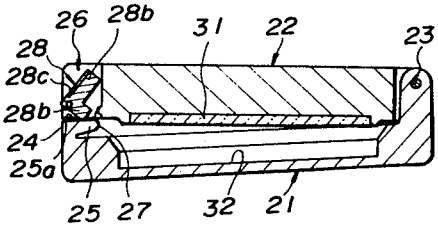

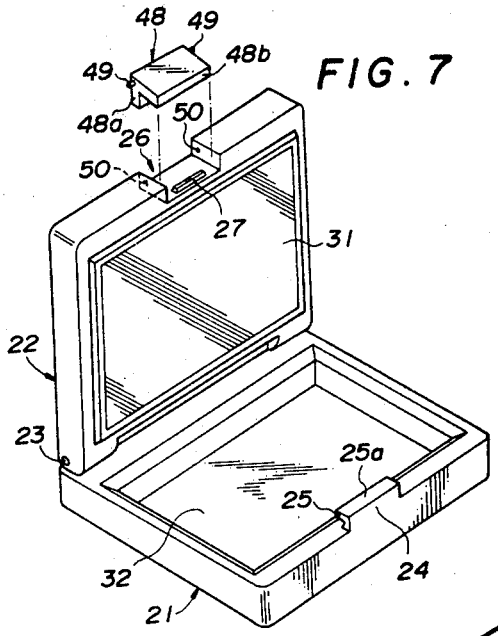
FIG. 7
FIG. 8
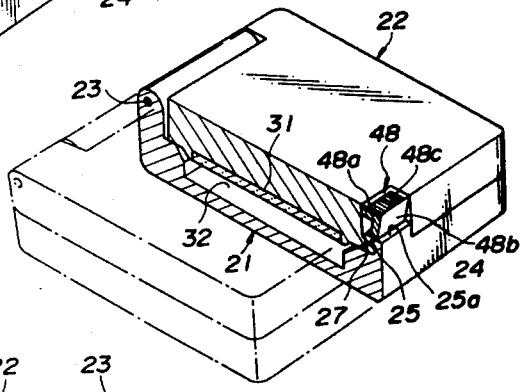
FIG. 9
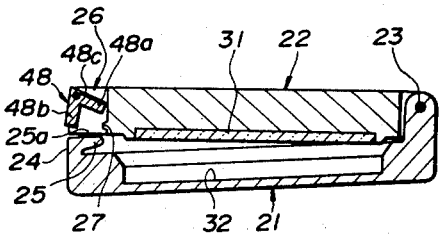

VANITY CASE

BACKGROUND OF THE INVENTION

The present invention relates to improvement of a vanity case, and more particularly to improvement of a latch-unlatch mechanism of a synthetic resin-made vanity case having a receptacle member and a cover member hinged with each other and arranged to be latched by snap engagement of an elastic latch tongue formed on one of the members with a protrusion on the other member.

In known vanity cases of the abovesaid type, the elastic latch tongue and the protrusion are formed integrally with the cover and receptacle members by plastic molding. The elastic tongue and the protrusion have to be formed very precisely in dimensions; otherwise, the vanity cases would accidentally open when unwanted due to the weakness of the engagement between the latch tongue and the protrusion, or if the engagement therebetween is too strong, a relatively large force has to be exerted to open and cover member, causing a trouble to the user. Accordingly, when molding the cover and receptacle members, the utmost attention has been paid to the accuracy to the dimensions of the latch tongue and the protrusion. However, quite a number of vanity cases are rejected as defective owing to improper engagement between the latch tongue and the protrusion.

With ordinary vanity cases heretofore employed, it is relatively troublesome to open the cover as the user usually pries open the front edge of the cover with the thumb of one hand while holding the front edge of the receptacle with the thumb of the other hand. And if the engagement between the latch tongue and the protrusion is unduly strong, a strong force has to be exerted to disengage them, often resulting in the contents of the case dropping out therefrom because of sudden opening of the case.

In order to provide an improved vanity case, it has been proposed to employ a slider element which serves as an unlatch member for disengaging the latch tongue from the protrusion. This proposal has successively settled the above defects to the considerable extent. In such a vanity case, however, it is necessary to provide a cavity in either one of the receptacle or cover member for receiving the slider element, which inevitably makes thin portions easy to break above and below the cavity. Also, the slider element has been found not to operate so smoothly when it is not exactly fitted in the slender cavity.

Therefore, an object of the present invention is to provide a vanity case which is free from all the above defects and can easily be opened with a light tough thereon.

It is another object of the present invention to provide a vanity case which is very simple in structure and assembly, and is reliable in operation.

SUMMARY OF THE INVENTION

A vanity case according to the present invention comprises a receptacle member for containing cosmetic material, a cover member hinged with the receptacle member at the rear end thereof, a first latching protrusion integrally formed with the cover member, a second latching protrusion integrally formed with the receptacle member for engagement with the first latching protrusion by snap action when the cover member is closed over the receptacle member, and an unlatch member disposed in either one of the receptacle member or the cover member. The unlatch member is formed to an angular shape including a substantially horizontally extended portion and a substantially vertically extended portion and is housed in a rectangular recess formed in either one of the receptacle member and the cover member, being pivotably connected at the angular corner thereof to the receptacle or cover member. The unlatch member is so arranged that when one of said extended portions is pressed to have the angular member pivot about the angular corner, the other of the extended portions acts on a flat surface of the other of the cover member and the receptacle member so as to force the cover member away from the receptacle member, thereby releasing engagement between the first and second latching protrusions and moving the cover member to an open position.

Preferably, one of the extended portions of the unlatch member, which is to be pressed, is formed longer than the other of the extended portions.

Further objects and features of the present invention will become apparent from the detailed description of preferred embodiments thereof when taken in conjunction with the accompanying drawings, in which:

BRIEF DESCRIPTION OF THE DRAWINGS

FIG. 4 is a perspective view showing a vanity case according to a second embodiment of the present invention with a cover member opened and an unlatch member in exploded view;

FIG. 5 is a partially sectioned perspective view of the vanity case shown in FIG. 4 with the cover member closed;

FIG. 6 is a sectional view of the vanity case of FIG. 4 with the unlatch member in a manipulated position;

FIG. 7 is a perspective view of a third embodiment of a vanity case of the present invention, with a cover member opened and an unlatch member in exploded view;

FIG. 8 is a partially sectioned perspective view of the vanity case in FIG. 7 with the cover member closed;

FIG. 9 is a sectional view of the vanity case in FIG. 7 with the unlatch member in a manipulated position;

DETAILED DESCRIPTION OF THE INVENTION

Figure 1:
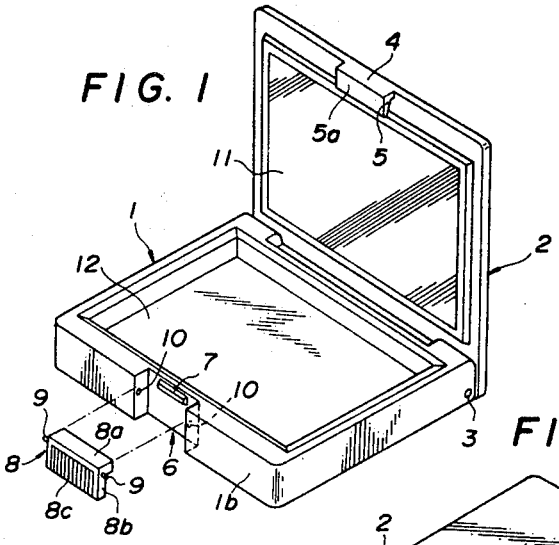
FIG. 1 is a perspective view illustrating a vanity case according to a first embodiment of the present invention, with a cover member opened, wherein an unlatch member is shown in exploded view before assembling thereof with a receptacle member.
Figure 2:
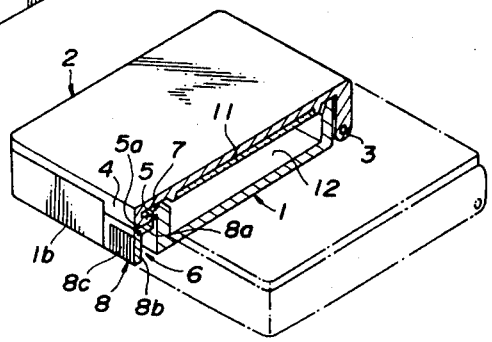
FIG. 2 is a partially sectioned perspective view showing the vanity case with the cover member closed.
Figure 3:
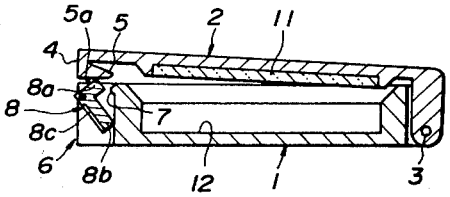
FIG. 3 is a sectional view of the vanity case with the cover member partially opened by manipulating the unlatch member.
Figure 10:
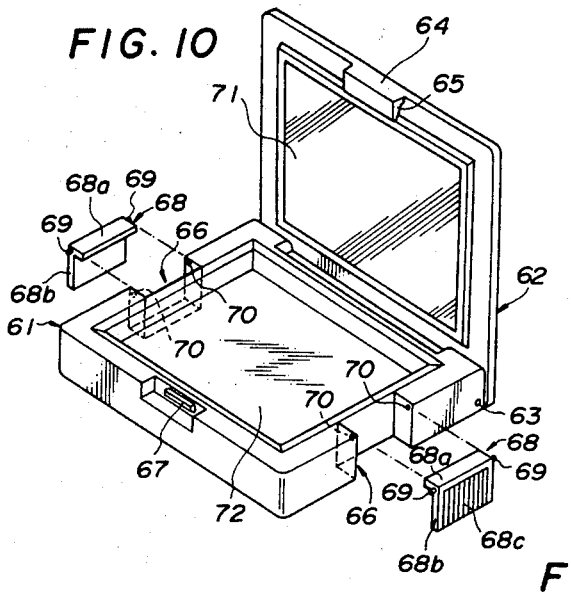
FIG. 10 is a perspective view illustrating a vanity case according to a fourth embodiment of the present invention with a cover member opened and unlatch members in exploded view.

Referring now to FIGS. 1 to 3 of the drawings, there is shown a vanity case according to a first embodiment of the present invention. The vanity case comprises a synthetic resin-made receptacle member 1 and a cover member 2 which is coupled at the rear end thereof with the receptacle 1 by means of a hinge 3. The cover member 2 has a latch nose 4 formed integrally therewith and extending downwardly from the central portion of the front end thereof. The latch nose 4 is inwardly or rearwardly cornered at the lower portion thereof to form a latch tongue 5 which has a flat lower surface 5*a*. A rectangular recess 6 is provided in the front end of the receptacle 1 at a position corresponding to the latch nose 4. An end wall defining the recess 6 has a protrusion 7 integrally formed therewith. When pressing down the cover member 2, the latch tongue 5 is snapped into engagement with the protrusion 7 to close the vanity case.

Disposed in the recess 6 is an angularly shaped unlatch member 8 having an inverted "L" section. The angular member 8 is provided at each side corner portion with a boss 9 which is received in a hole 10 formed in each side wall of the recess 6, whereby the angular member 8 is pivotably connected to the receptacle 1. This angular member 8 has a horizontally extended free end 8*a* and a vertically extended free end 8*b*, the latter preferably being formed longer than the horizontal end 8*a* with the outer surface 8*c* arranged in alignment with the outer end wall 1*b* of the receptacle 1 when the angular member 8 is fitted in the recess 6. As shown in FIG. 2, the upper surface of the horizontal free end 8*a* makes contact with the flat lower surface 5*a* of the latch tongue 5 integrally provided with the cover 2.

Further provided in the compact case is a mirror 11 attached to the cover 2 and a hollow space 12 for cosmetics in the receptacle 1.

Assuming that the cover member 2 is closed upon the receptacle 1 with the latch tongue 5 being engaged with the protrusion 7 as shown in FIG. 2, when the vertical end 8*b* is pressed towards the end wall of the recess 6, the inverted L-shaped angular member 8 pivots in a counter-clockwise direction about the bosses 9—9 provided at the corners thereof and fitted into the holes 10—10. In consequence, the horizontal free end 8*a* of the angular member 8 acts on the flat lower surface 5*a* of the latch tongue 5 to push up the front end of the cover 2 thereby disengaging the tongue 5 from the protrusion 7 as shown in FIG. 3. At the same time the cover member 2 is partially opened, permitting the user to freely set the mirror 11 at a desired angle.

As it could be understood from the description of the first embodiment of the present invention, the cover member 2 can easily be opened by inwardly pressing the vertical free end 8*b* of the angular member 8, thus eliminating such an action as prying the cover 2 open as in the past. Also, to form the vertical free end 8*b* longer than the horizontal end 8*a* more facilitates to open the cover 2 by a small force due to the leverage. Furthermore, the angular member 8 is very simple in structure and decently housed in the rectangular recess 6 without any slender cavity which tends to cause some troubles in assembly and is use.

Reference is now made to a second embodiment of the present invention shown in FIGS. 4 to 6. Different from the first embodiment, a cover member 22 of this embodiment is provided at the front end thereof with a rectangular recess 26 in which a L-shaped angular member 28 is pivotably connected by a pair of bosses 29—29 received into holes 30—30, and a receptacle member 21 is provided with a latch nose 24 having a latch tongue 25. In the closed position of the cover member 22 where a horizontal free end 28*a* makes contact with an upper flat surface 25*a* of the nose 25 as shown in FIG. 5, when a vertical free end 8*b* is pressed towards the end wall of the recess 26, the angular member 8 pivots in a clockwise direction about the bosses 29—29 and the horizontal end 8*a* acts on the flat surface 25*a* to push down the front end of the receptacle 21, so that an engagement between the latch tongue 25 and a protrusion 27 is released and the cover 22 is partially opened, as shown in FIG. 6.

Other structures and operations of the second embodiment are substantially the same as in the first embodiment and, therefore, the parts same as or corresponding to those in the first embodiment are indicated by the same reference numeral but with addition of 20.

FIGS. 7 to 9 illustrate a third embodiment of the present invention. In this embodiment, an angular member 48 is pivotably connected into the rectangular recess 26 formed in the cover member 22 as in the second embodiment, but in such a manner that an upper surface 48*c* of a horizontal free end 48*a* is aligned with an upper surface of the cover 22 while a vertical free end 48*b* is at a lower edge thereof in touch with the flat upper surface 25*a* of the latch nose 25 when the cover 22 is closed over the receptacle 21 as shown in FIG. 8. The angular member 48 of this embodiment has an acute angle at the corner between the horizontal end 48*a* and the vertical end 48*b*. Preferably, the horizontal free end 48*a* is formed longer than the vertical free end 48*b* in order to harness the leverage.

For opening the cover 22 in the third embodiment, the horizontal end 48*a* is pressed downwardly to have the angular member 48 pivot about bosses 49—49 which are received in the holes 50—50, respectively, each formed at the upper part of the side wall of the recess 26. Then, the vertical end 48*b* acts on the flat surface 25*a* and pushes down the receptacle 21 so that the latch tongue 27 is disengaged from the protrusion 25 as shown in FIG. 9.

It would be apparent that the second and third embodiments have the same advantages as those in the first embodiment. Moreover, in the third embodiment the rectangular recess 26 is concealed by both free ends 48*a* and 48*b* of the angular member 48 and, therefore, the external appearance of the compact case becomes good.

Figure 11:
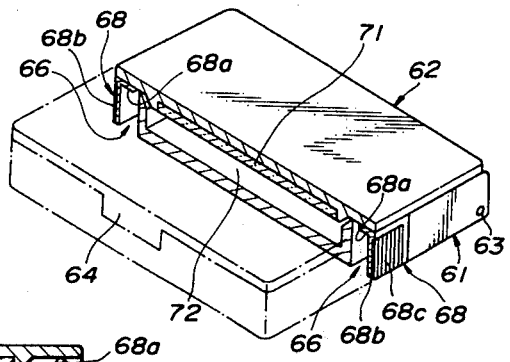
FIG. 11 is a partially sectioned perspective view of the vanity case in FIG. 10 with the cover member opened.
Figure 12:
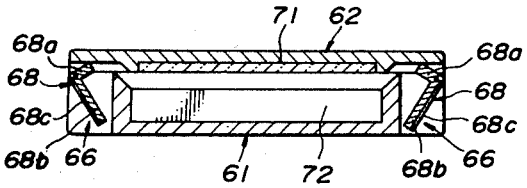
FIG. 12 is a sectional view of the vanity case in FIG. 10 with the unlatch members in a manipulated position.

In the embodiments set forth above, the angular member has been provided at the front end of the receptacle or cover. However, it is also possible to dispose the angular member at each side portion of the receptacle or cover. FIGS. 10 to 13 show such an embodiment in which rectangular recesses 66—66 are formed in both side marginal portions of the receptacle 61 centrally thereof and inverted L-shaped angular members 68—68 of the same arrangement as described above in respect of the first embodiment are each pivotably connected to the receptacle 61 in the recess 66. A horizontal free end 68*a* of each angular member 66 is in touch with an inner flat surface of the side marginal portion of the cover 62 in the closed position of the cover as shown in FIG. 11, while a vertical free end 68*b* may be aligned with the outer side wall of the receptacle 61. When the vertical free ends 68*b*—68*b* are pressed towards the end walls of the recesses 66—66, the angular members 68—68 pivot about the bosses 69—69 whereby the horizontal ends 68*a*—68*a* push up the cover 62 as shown in FIG. 12 to release the engagement between the latch tongue 65 and the protrusion 67 formed at the front ends of the receptacle 61 and cover 62, respectively.

Figure 13:
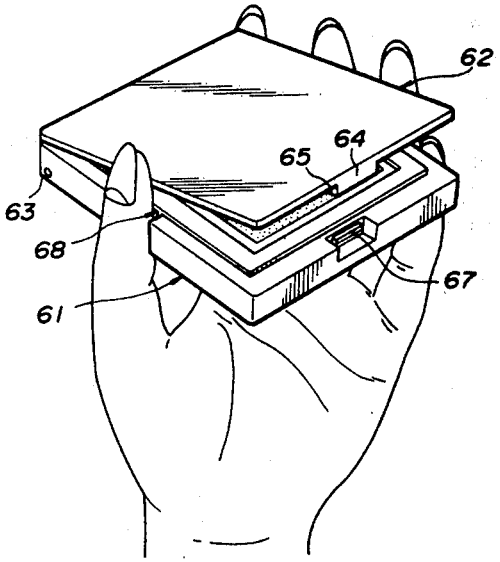
FIG. 13 is a perspective view of the same vanity case showing a manner to open the cover member.

With the arrangement of this embodiment, the cover member 63 can be opened simply by a one-hand operation consisting of pressing the vertical ends 68*b*—68*b* of both angular members 68 by the thumb and the middle finger of the user's hand holding the compact case of the palm thereof, as shown in FIG. 13.

Although the forth embodiment has been described in connection with the case where a pair of angular member are each installed in the recess formed in the receptacle, it is also possible to form the recess at each side portion of the cover in which the angular member is disposed substantially in the same way as in the second embodiment and/or the third embodiment.

Also, the angular member in the above embodiments has been described as inverted L-shaped or L-shape. However, the angular member may be formed in other shapes which partially contain "L" having an angular corner at which the angular member is pivotably connected into the recess.

It will be apparent that many modifications and variations may be made within the spirit of the present invention.

What is claimed is:

1. A synthetic resin-made vanity case comprising:

a receptacle member for containing a cosmetic material therein;

a cover member hinged with said receptacle at the rear end thereof;

a first latching protrusion integrally formed with said corner cover member;

a second latching protrusion integrally formed with said receptacle member for engagement with said first latching protrusion by snap action when said cover member is closed over said receptacle member; and an unlatch member disposed in either one of said receptacle member and said cover member;

characterized in that said unlatch member is formed to an angular shape including a substantially horizontally extended portion and a substantially vertically extended portion; said unlatch member is housed in a rectangular recess formed in either one of said receptacle member and said cover member and is pivotably connected at the angular corner thereof to said receptacle or cover member; and that said unlatch member is so arranged that when one of said extended portions is pressed to have said unlatch member pivot about said angular corner, the other of said extended portions acts on a flat surface of the other of said cover member and said receptacle member so as to force said cover member away from said receptacle member, thereby releasing engagement between said first and second latching protrusions and moving said cover member to an open position.

2. A vanity case as claimed in claim 1, characterized in that one of said extended portions of said unlatch member which is to be pressed is formed longer than the other of said extended portions.

3. A vanity case as claimed in claim 1 or 2, characterized in that said rectangular recess is formed in a marginal portion of said receptacle member and that said unlatch member is pivotably connected to said receptacle member in such a manner that said horizontally extended portion is at the upper surface thereof in contact with the inner flat surface of said cover member in said closed position of said cover member.

4. A vanity case as claimed in claim 1 or 2, characterized in that said rectangular recess is formed in a marginal portion of said cover member to which said unlatch member is pivotably connected in said recess with said horizontally extended portion being at the lower surface thereof in contact with the upper surface of said receptacle member when said cover member is closed.

5. A vanity case as claimed in claim 1 or 2, characterized in that said rectangular recess is formed in a marginal portion of said cover member to which said unlatch member is pivotably connected in said recess, said vertically extended portion of said unlatch member being at the lower end thereof in touch with the upper flat surface of said receptacle member in said closed position of said cover member.

* * * * *